US005421664A

United States Patent [19]

Okamoto

[11] Patent Number: 5,421,664

[45] Date of Patent: Jun. 6, 1995

[54] FLUID APPLICATOR WITH FLUID TANK PRESSURIZATION DEVICE

[75] Inventor: Hideshi Okamoto, Tokyo, Japan

[73] Assignee: Sailor Pen Co. Ltd., Tokyo, Japan

[21] Appl. No.: 218,652

[22] Filed: Mar. 28, 1994

[30] Foreign Application Priority Data

Apr. 23, 1993 [JP] Japan ..... 5-026552 U
Nov. 11, 1993 [JP] Japan ..... 5-064924 U

[51] Int. Cl.[6] ..... B43K 9/00; B43K 7/00

[52] U.S. Cl. ..... 401/213; 401/187; 401/188 A; 401/214

[58] Field of Search ..... 401/213, 214, 187, 188 A

[56] References Cited

U.S. PATENT DOCUMENTS

| | | | |
|---|---|---|---|
| 1,848,358 | 3/1932 | Kratz | 401/187 |
| 2,930,062 | 3/1960 | Reimann | 401/214 |
| 3,578,870 | 5/1971 | Viti | 401/202 X |
| 4,573,818 | 3/1986 | Kodera | 401/202 X |
| 4,969,766 | 11/1990 | Nagle et al. | 401/213 X |
| 5,051,015 | 9/1991 | Moeck | 401/213 X |

FOREIGN PATENT DOCUMENTS

| | | | |
|---|---|---|---|
| 1012842 | 7/1952 | France | 401/214 |
| 1044198 | 11/1953 | France | 401/213 |
| 270136 | 11/1950 | Switzerland | 401/213 |

*Primary Examiner*—Steven A. Bratlie
*Attorney, Agent, or Firm*—Frishauf, Holtz, Goodman & Woodward

[57] ABSTRACT

A fluid applicator in which the internal pressure of a fluid tank can selectively be increased, and the fluid to be applied is prevented from being discharged excessively during application. A cap is provided with a short first inner barrel and a long second inner barrel, so that, when the neck of the applicator is inserted into the short first inner barrel to seal the tip, the pressure rise in the first inner barrel is adapted to be small so as not to substantially increase the internal pressure of the fluid tank, whereas when the neck is inserted into the long second inner barrel, the pressure rise in the second inner barrel is adapted to be great so as to increase the internal pressure of the fluid tank. Alternatively, the applicator may be provided with a pressurizing device having a plurality of sealing barrels of different lengths.

13 Claims, 2 Drawing Sheets

FLUID APPLICATOR WITH FLUID TANK PRESSURIZATION DEVICE

BACKGROUND OF THE INVENTION

This invention relates to a fluid applicator which is filled with a highly viscous fluid such as correction fluid or make-up fluid.

In an applicator having a spherical application member (applicator ball), a tip is attached to the neck formed at the front end of a fluid tank which is filled with a fluid to be applied, and the tip rotatably supports therein an applicator ball in such a way that the applicator ball may partly be exposed from the front edge thereof like in a ball-point pen. The applicator ball is resiliently urged by a spring so as to bring the applicator ball into intimate contact with an inwardly tapered front edge of the tip, when the applicator is not used, to allow the applicator ball and the front edge of the tip to form a valve, preventing the fluid from being discharged.

When the applicator ball is pressed against a surface to be treated by application of the fluid, the applicator ball retracts against the resilience of the spring to provide a clearance between the applicator ball and the front edge of the tip, allowing the fluid behind the applicator ball within the tip to be delivered through the clearance to the outside of the tip and applied as the applicator ball rolls. However, since the fluid is highly viscous, the fluid cannot normally be fed freely to the surface of the applicator ball. Accordingly, the fluid tank is molded by means of blowing using a flexible material so as to be squeezable, and the fluid tank is pressed between the user's fingers to increase the internal pressure of the fluid tank when the applicator is used to allow the fluid to be fed out to the exposed surface of the applicator ball with the aid of the thus increased pressure.

Thus, the prior art applicator suffers from the disadvantage that the handling thereof is troublesome since the fluid tank must be pressed between the fingers to increase the internal pressure when the fluid is to be applied, and besides the production cost of a fluid tank blow-molded from flexible material is relatively high.

Therefore, if a cap is designed to be push-fitted to the neck of the applicator with the front end portion of the tip being sealed inner barrel of the cap to reduce the volume of the sealed space defined within the inner barrel in the process that the cap being engaged with the neck, the internal pressure of the inner barrel can be increased. Accordingly, the application ball retracts to allow the air in the inner barrel to intrude into the fluid tank and increase the internal pressure of the fluid tank, and thus the fluid tank need not be pressed between the fingers for application of the fluid.

However, since the internal pressure of the fluid tank is increased each time the cap is fitted in such cap pressurizing system, the internal pressure of the fluid tank becomes too high, and it sometimes happens that the fluid to be applied is discharged excessively when the applicator is used.

OBJECT AND SUMMARY OF THE INVENTION

Therefore, the present invention is directed to provide an applicator in which the level of increase in the internal pressure of the fluid tank can be selected so as to prevent the fluid from being discharged excessively during application.

In order to attain the intended objects, the applicator according to a first aspect of the invention has an applicator ball retained rotatably in a tip such that the applicator ball may partly be exposed from the front edge of the tip, a spring for resiliently urging the applicator ball to be abutted against the inwardly tapered front edge of the tip, a neck holding the tip therein, and a fluid tank formed in fluid communication with the neck, in which a highly viscous film-forming fluid to be applied is contained; the tip being adapted to be sealed by a cap when the outer circumference of the neck is brought into intimate contact with the inner circumference of an inner barrel of the cap; wherein a short first inner barrel and a long second inner barrel are disposed in the cap so that the opening of the first inner barrel and that of the second inner barrel may face in opposite directions; and when the neck is inserted to the short first inner barrel to seal the tip, the internal pressure of the first inner barrel is increased a little, so that the internal pressure of the fluid tank may not substantially be increased, whereas when the neck is inserted to the long second inner barrel to seal the tip, the internal pressure of the second inner barrel is increased greatly, so that the internal pressure of the fluid tank may be increased.

According to a second aspect of the invention, the applicator has an applicator ball retained rotatably in a tip such that the applicator ball may partly be exposed from the front edge of the tip, a spring for resiliently urging the applicator ball to be abutted against an inwardly tapered front edge of the tip, a neck holding the tip therein, and a fluid tank formed in fluid communication with the neck, in which a highly viscous film-forming fluid to be applied is contained, wherein the applicator additionally is provided with a pressurizing means provided with a plurality of sealing barrels having different lengths, so that the internal pressure of the fluid tank may be increased, when the neck is inserted to one of the sealing barrels to seal the tip and increase the internal pressure of the corresponding sealing barrel to a level depending on the length thereof.

More specifically, in the first aspect of the invention, since the internal pressure of the fluid tank is adapted not to be substantially increased when the neck is inserted to the short first inner barrel to seal the tip but to be increased when it is inserted to the long second inner barrel to seal the tip, the internal pressure of the fluid tank can be maintained at the optimum level by selecting the inner barrel to which the neck is to be inserted depending on the condition of desired fluid discharge, preventing the fluid from being discharged excessively.

Meanwhile, in the second aspect of the invention, a pressurizing means provided with a plurality of sealing barrels having different lengths is additionally provided. Accordingly, when a suitable length of sealing barrel is selected and the neck is inserted thereto to seal the tip thereby, the internal pressure is increased depending on the length sealing barrel to allow the internal pressure of the fluid tank to be maintained at the optimum level, preventing the fluid from being discharged excessively.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

DETAILED DESCRIPTION OF PREFERRED EMBODIMENTS

Figure 4:
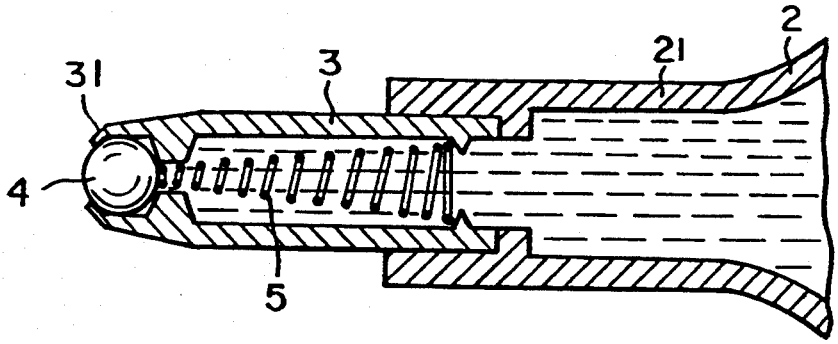
FIG. 4 shows a cross section of the applicator.

The present invention will now be described below specifically based on the embodiments shown in the attached drawings. In FIG. 4, a tip 3 is fitted in the front opening of a neck 2 having a reduced sealing portion 21 at the front end. The sealing portion 21 which is to be brought into intimate contact with the inner circumference of the inner barrel of a cap or closure, as will be described later, may be provided with an annular ridge at the front edge thereof so that the annular ridge may be brought into intimate contact with the inner circumference of the inner barrel of the cap. The tip 3 is made of stainless steel and is of generally cylindrical form, with an inwardly tapered end; and an application ball 4 which is a hard ball having a diameter of 1.0 mm is rotatably retained in the ball housing defined at the front end portion of the tip 3 so that the applicator ball 4 may partly protrude from the front edge of the tip 3. The tip 3 may be made of a metal pipe.

Figure 1:
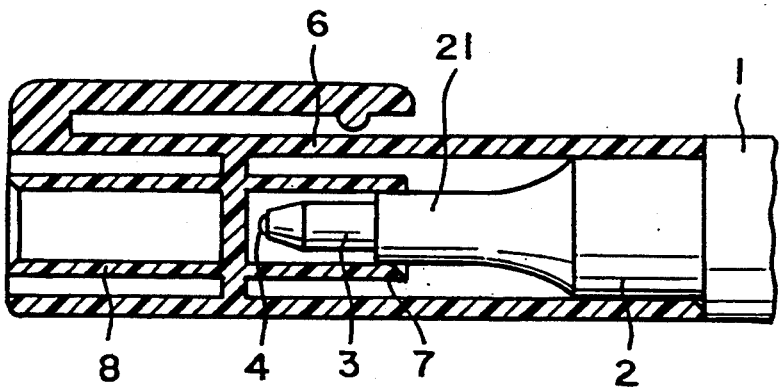
FIG. 1 shows a cross-sectional view of the applicator according to the first aspect of the invention.

A small spring 5 having a spring power of 40 g is disposed in the tip 3 and resiliently urges the applicator ball 4 to be in press contact with the inwardly tapered front edge 31 of the tip 3 and to allow the applicator ball 4 and the front edge 31 of the tip 3 to constitute a valve mechanism. The neck 2 is formed integrally with a fluid tank 1, as shown in FIG. 1. The fluid tank 1 is injection molded using an ordinary rigid synthetic resin and can be produced at a low cost compared with those molded by means of blowing using flexible materials. A fluid to be applied, for example a correction fluid having a high film-forming property with a viscosity of 30 to 40 cps is charged in the fluid tank 1 through the cavities in the neck 2 and tip 3. The fluid to be applied may also be a so-called ink having a viscosity of about 30 to 40 cps, and in such cases the applicator can be used in the same manner as a ball-point pen.

Figure 2:
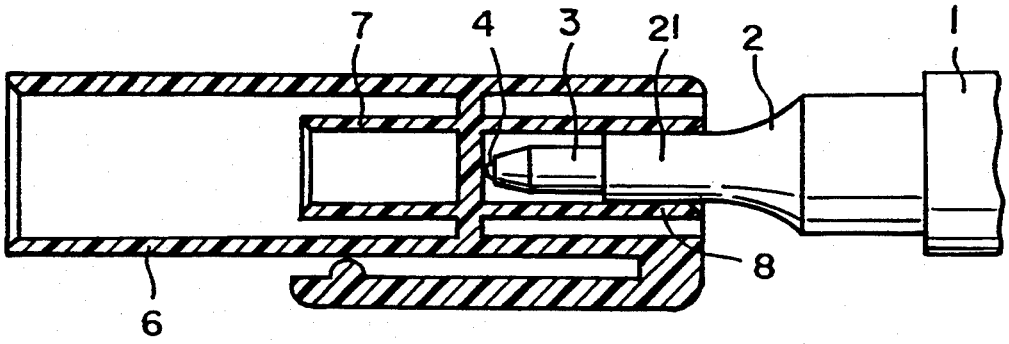
FIG. 2 is an explanatory view showing how to use the cap according to the first aspect of the invention.

FIGS. 1 and 2 show an embodiment according to the first aspect of the invention. The cap or closure 6 is molded using a synthetic resin and has a short first inner barrel 7 and a long second inner barrel 8 formed integrally therein such that the opening of the first inner barrel 7 and that of the second inner barrel 8 may face in opposite directions, as shown in FIG. 1. While the neck 2 can be inserted to either the first inner barrel 7 or the second inner barrel 8, the internal portion of the first inner barrel 7 or of the second inner barrel 8 provides a sealed space when the inner circumference of the first inner barrel 7 or of the second inner barrel 8 is brought into intimate contact with the outer circumference of the sealing portion 21 of the neck 2, thus sealing the tip 3.

After completion of application, the neck 2 is inserted to the first inner barrel 7, as shown in FIG. 1. Since the first inner barrel 7 is short, the edge of the first inner barrel 7 slides only a little on the sealing portion 21 of the neck 2 when the cap is fully engaged with the neck 2. In other words, since the loss in the volume of the sealed space in the first inner barrel 7 is very small, the internal pressure of the first inner barrel 7 is increased a little, and thus the internal pressure of the fluid tank 1 is not substantially increased. Accordingly, the internal pressure of the fluid tank 1 is not excessively increase by fitting the cap 6 but can be maintained at the same level before fitting of the cap. Accordingly, the fluid is prevented from being discharged excessively when the applicator is used next time.

Next, when the internal pressure of the application tank 1 drops in the course of application and the discharge of the fluid to be applied becomes small, the neck 2 is inserted to the long second inner barrel 8, as shown in FIG. 2. In this process, the edge of the second inner barrel 8 is brought into intimate contact with the outer circumference of the sealing portion 21 of the neck 2 to provide a sealed space in the second inner barrel 8. When the cap 6 is further pushed forward, the inner circumference of the second inner barrel 8 slides on the outer circumference of the sealing portion 21 while maintaining intimate contact with the sealing portion 21 to reduce the volume of the sealed space in the second inner barrel 8, and the air in the second inner barrel 8 is pressurized. Thus, the application ball 4 is retracted by this pressure to provide a clearance between the application ball 4 and the front edge or annular shoulder 31 of the tip 3, so that the air in the second inner barrel 8 intrudes into the fluid tank 1 to increase the internal pressure of the fluid tank 1. Accordingly, when the cap 6 is removed so as to apply the fluid, the fluid may flow freely again to the applicator ball 4 so that the fluid tank 1 need not be pressed between the fingers, and thus the fluid can properly be applied by using the applicator in the same manner as writing with a ball-point pen.

If a valve member, for example, a thin annular rubber packing having a center hole is disposed in the second inner barrel 8, the internal pressure of the fluid tank 1 can efficiently be increased without elongating so much the second inner barrel 8. The valve member is abutted against the applicator ball 4 to force the application ball 4 to retract in the process that the neck 2 is inserted into the second inner barrel 8, and the abutment of the valve member with the applicator ball 4 is released, when the cap 6 is fully engaged with the neck 2, to allow the application ball 4 to resume contact with the front edge 31 of the tip 3.

Figure 3:
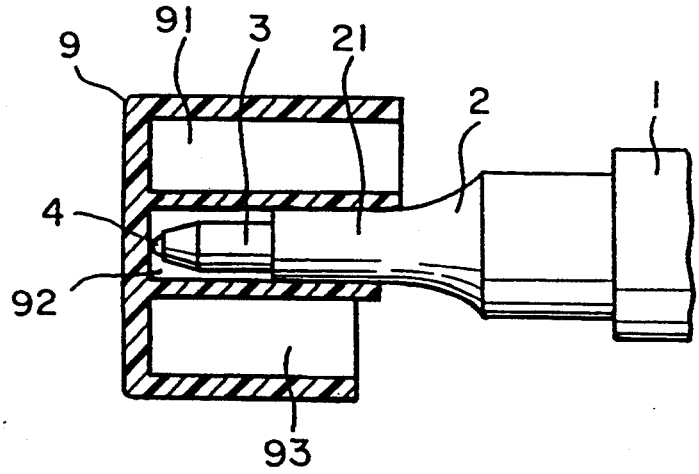
FIG. 3 shows a cross-sectional view of the applicator according to the second aspect of the invention.

Next, FIG. 3 shows an embodiment according to the second aspect of the invention. In this embodiment, an ordinary cap (not shown) which is not particularly designed to increase the internal pressure of the fluid tank when engaged with the applicator is used, but a pressurizing means 9 is provided in addition to the cap. The pressurizing means 9 is provided with a plurality of, for example 3, sealing barrels 91,92,93 having different lengths. While the neck 2 can be inserted to any of the sealing barrels 91,92,93, the tip 3 is adapted to be sealed by one of the sealing barrels 91,92,93 when the inner circumference at the front end portion thereof is brought into intimate contact with the outer circumference of the sealing portion 21 of the neck 2 to provide a sealed space in the sealing barrel 91,92 or 93.

Thus, depending on the state of pressurization in the fluid tank 1, one of the sealing barrels 91,92,93 is selected. Namely, when the discharge of the fluid is small due to the low internal pressure, the neck 2 is inserted to the long sealing barrel; whereas when the internal pressure is relatively high and no prompt pressurization is required, the neck 2 is inserted to the short sealing barrel until the applicator ball 4 is abutted against the bottom of the sealing barrel. Accordingly, the internal pressure of the sealing barrel is increased depending on the length thereof, and thus the applicator ball 4 is retracted to allow the pressurized air to intrude into the fluid tank 1. However, since the internal pressure of the fluid tank 1 is maintained at the optimum level, it never happens that the fluid is discharged excessively.

As has been described heretofore, a short first inner barrel and a long second inner barrel are provided in the cap in the applicator according to the first aspect of the invention, so that the internal pressure of the fluid tank may not substantially be increased when the neck is inserted to the short first inner barrel and that the internal pressure of the fluid tank may be increased when the neck is inserted to the long second inner barrel. Accordingly, the internal pressure of the fluid tank can be maintained at the optimum level by selecting the inner barrel to be engaged with the applicator depending on the state that the fluid is being discharged, and thus the fluid is prevented from being discharged excessively. Further, the fluid tank need not be pressed between the fingers when the applicator is used, and besides the fluid tank need not be molded by means of blowing using a flexible material but can be injection molded using an ordinary rigid synthetic resin, so that the applicator can be produced at a low cost.

Meanwhile, in the applicator according to the second aspect of the invention, a pressurizing means provided with a plurality of sealing barrels having different lengths is additionally provided as an accessory, the internal pressure of the fluid tank can be maintained at the optimum level by selecting an appropriate length of sealing barrel to be engaged therewith, preventing the fluid from being discharged excessively.

Although two embodiments of the present invention have been described herein, it should be apparent to those skilled in the art that the present invention may be embodied in many other specific forms without departing from the spirit or scope of the invention.

What is claimed is:

1. A fluid applicator system, comprising a fluid applicator and a closure member which is removably attachable to the fluid applicator, said fluid applicator comprising:

a fluid tank;

a neck connected to the tank in fluid communication with the tank, and wherein the neck has a sealing portion of predetermined exterior circumferential configuration;

a tip in fluid communication with the neck and forming a housing provided with an opening forming an annular shoulder;

an applicator ball rotatably retained by the annular shoulder in the housing and partially protruding through the opening; and a spring biasing the applicator ball into engagement with the annular shoulder; and said closure member comprising:

a plurality of inner barrels of different depths, each inner barrel being closed at one end and each inner barrel having an interior circumferential sealing portion complementing the exterior configuration of the sealing portion of the neck;

and wherein any one of the plurality of inner barrels is adapted to receive the neck therein, when the closure member is being attached to the applicator, whereby air entrapped within the barrel due to the sealing portion of the inner barrel of the closure member sealing against the sealing portion of the neck, pushes the applicator ball at least partially out of engagement with the annular shoulder against the bias of the spring and enters into the fluid tank to raise the internal pressure thereof, the applicator ball thereafter returning into its engagement with the annular shoulder.

2. The fluid applicator system of claim 1, wherein each inner barrel is dimensioned to raise the internal pressure of the fluid tank by a different amount.

3. The fluid applicator system of claim 2, wherein the closure member comprises first and second inner barrels.

4. The fluid applicator system of claim 3, wherein the closure member comprises a cap, and wherein the first and second inner barrels are axially aligned.

5. The fluid applicator system of claim 4 wherein the inner barrels are open at opposite ends of the closure member.

6. The fluid applicator system of claim 2, wherein the inner barrels are arranged in side-by-side relationship.

7. The fluid applicator system of claim 6, wherein the inner barrels are open in the same direction.

8. The fluid applicator system of claim 1, wherein the neck has a cavity therein which is joined within the housing, and the spring is provided within the cavity.

9. The fluid applicator system of claim 8, wherein the spring is in contact with the applicator ball.

10. The fluid applicator system of claim 1, wherein the spring is in contact with the applicator ball.

11. The fluid applicator system of claim 1, wherein one of said plurality of inner barrels is dimensioned so as to increase the internal pressure of the fluid tank by only a small amount when said at least one inner barrel is received on the neck of the fluid applicator, and wherein another of said inner barrels is dimensioned to increase the internal pressure of the fluid tank by a larger amount when said another inner barrel is received on the neck of the fluid applicator.

12. The fluid applicator system of claim of 11, wherein said another inner barrel has a longer internal length then at least said at least one inner barrel.

13. The fluid applicator system of claim 11, wherein the interior circumferential sealing portion of each of said inner barrels is identically configured.

* * * * *